United States Patent [19]

Kvalheim

[11] Patent Number: 4,793,655

[45] Date of Patent: Dec. 27, 1988

[54] MULTI-POSITION CONVERTIBLE THERAPEUTIC CHAIR

[75] Inventor: Andrew M. Kvalheim; Flemming M. Pedersen, both of Petaluma, Calif.

[73] Assignee: Kval Marketing Inc., Petaluma, Calif.

[21] Appl. No.: 28,580

[22] Filed: Mar. 20, 1987

[51] Int. Cl.[4] ..... A47C 7/50

[52] U.S. Cl. ..... 297/423; 297/118; 297/195; 297/338; 297/355

[58] Field of Search ..... 297/423, 429

[56] References Cited

U.S. PATENT DOCUMENTS

| | | | |
|---|---|---|---|
| 3,669,493 | 6/1972 | Vowles | 297/429 |
| 3,837,705 | 9/1974 | Marraccini | 297/353 |
| 4,328,991 | 5/1982 | Mengshoel . | |
| 4,377,309 | 3/1983 | Mengshol | 297/423 |
| 4,564,237 | 1/1986 | Steifensand | 297/423 |
| 4,589,699 | 5/1986 | Dungan . | |
| 4,614,378 | 9/1986 | Picou | 297/429 X |
| 4,650,249 | 3/1987 | Serber | 297/423 X |

FOREIGN PATENT DOCUMENTS

| | | | |
|---|---|---|---|
| 0014001 | 8/1980 | European Pat. Off. | 297/429 |

*Primary Examiner*—James T. McCall
*Attorney, Agent, or Firm*—Alfons Puishes

[57] ABSTRACT

A chair is equipped with a seat rest cushion and support and a separate back rest cushion and support. The cushions are mounted on the chair frame and interconnected by a mechanism which permits swinging the back rest cushion downwards to a knee rest position while tilting the seat rest cushion forward to enable a person to assume a knee rest position on the chair. Also, further adjustments of the seat rest cushion to act as a back rest and the knee rest cushion to act as a seat rest provides a lounge chair. All of this out of the same original chair. Additional embodiments provide an additional cushion for a person while in a knee rest or lounge position of desired.

9 Claims, 6 Drawing Sheets

MULTI-POSITION CONVERTIBLE THERAPEUTIC CHAIR

FIELD OF THE INVENTION

The invention relates to chairs both for home and office use and particularly to chairs for providing comfort and relief to the bodies of persons from long sitting or persons afflicted with body ailments aggravated by sitting in a conventional seated position. More specifically it is concerned with chairs of the "sit-kneel" type in which the user's weight is partially supported by his knees and with chairs that may be readily converted from conventional seating type to chairs of the knee rest type.

BACKGROUND OF THE INVENTION AND PRIOR ART

It has long been recognized by physicians and physical therapists that sitting in a conventional chair for long periods of time produces back and muscle complaints as well as discomfort to the stomach and neck. This is brought about by the weight distribution which follows from the 90 degree angle which the body basically must assume when in a conventional sitting position. Persons working at a typewriter or computer console are known to especially suffer in this manner and the condition is obviously aggravated in the case of persons already having back complaints. To solve this problem there have been in use now for some years various embodiments of a therapeutic chair which eliminates the conventional backrest and instead provides a knee rest for the user upon which he may effectively lean forward and have his knees absorb some of his weight, thus relieving the back and spine. Such chairs have found wide use, not only in offices, but in homes as for example, for prolonged watching of television in addition to use by people having back troubles as mentioned above and in particular by pregnant women.

There is substantial prior patent art in this field, of which the following are examples.

U.S. Pat. No. 3,669,493 to Vowles. In addition to the provisions for a chair in the knee rest position, this patent also claims an arcuate support for the feet as an additional feature.

U.S. Pat. No. 4,328,991 to Mengshoel teaches a chair of this type mounted on runners after the manner of a rocking chair, which is an additional claimed feature.

U.S. Pat. No. 4,377,309 to Mengshoel teaches an ankle and knee support element and a storage space for the latter beneath the seat. It also claims variations of ankle supports and is thus distinguished from Vowles above.

U.S. Pat. No. 4,564,237 to Steifensand. This patent teaches a tubular wide frame support of a chair of this type to provide better stability, improved construction and assembly as distinguished from the foregoing.

U.S. Pat. No. 4,589,699 to Dungan. In addition to a separate angular tilting arrangement for the seat and knee rest, this patent covers the feature of a variation in lateral space between the seat and knee rest members as an improvement over the prior art.

A number of design patents have issued covering ornamental features of various emobidments of these chairs indicating their wide adoption.

In actual practice it is often customary to use a conventional chair for a period of time and then switch to a knee rest type of chair to obtain the relief afforded for a while and then switch back to a conventional chair. This, of course, requires having two separate chairs which is cumbersome especially in a business office.

Nowhere does the prior art suggest the construction of a chair which may be readily converted from conventional to therapeutic use as described above or for lounging use.

SUMMARY OF THE INVENTION

We have invented a chair which while basically a conventional chair with seat and vertical back rest may by merely simple manipulation be converted to a therapeutic knee rest type of chair and utilized as such. This we accomplish by providing a swivelling mechanism for the back rest which permits it to be disconnected from its normally vertical position and swung downwards in a vertical plane to occupy a knee rest position below the seat while simulatentously tilting the seat forward. The back rest thus becomes a knee rest and the seat tilts forward to provide the therapeutic construction described in the above background information.

In one embodiment we employ a rack, pinion, and swivel mechanism to effect the conversion while in an alternate embodiment we employ a latch, swivel and link mechanism to produce the same results. In either case, a single chair serves the double purpose of acting either as a conventional chair or as a therapeutic chair such as that discribed herein. Also in addition one of our embodiments may be readily converted to a lounge or reclining type of chair while in another embodiment we may employ an additional cushion to supply an additional backrest where desired when the chair is in the knee rest position.

More specifically our basic invention comprises two different embodiments. Our first, which we designate as chair No. 1 utilizes a rack and pinion mechanism capable of converting the chair from position No. 1 for conventional use to position No. 2 for knee rest use or when desired to position No. 3 to act as a lounge chair.

Our second embodiment, which we designate as chair No. 2 utilizes a latch, swivel and link mechanism capable of converting the chair from conventional use position No. 1 to therapeutic knee rest position No. 2. In a variation of chair No.2 we provide a back rest as well as a knee rest when desired. This we designate as position No. 3 for chair No. 2. All of the above are illustrated in the figures, a description of which follows.

DESCRIPTION OF A PREFERRED EMBODIMENT

Figure 1:
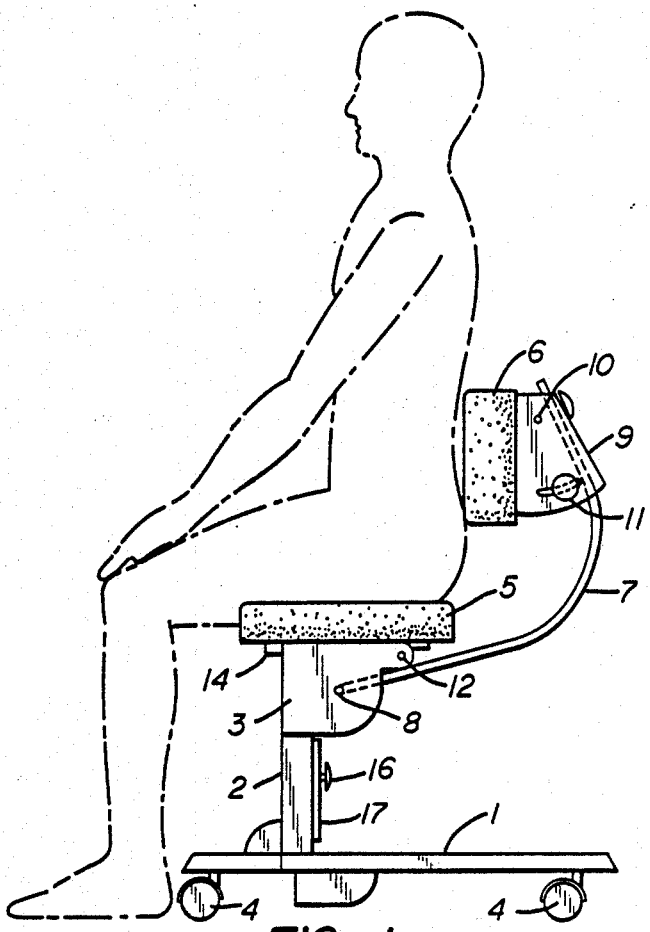
FIG. 1. Chair No. 1 side elevation. Chair in conventional position No. 1.
Figure 2:
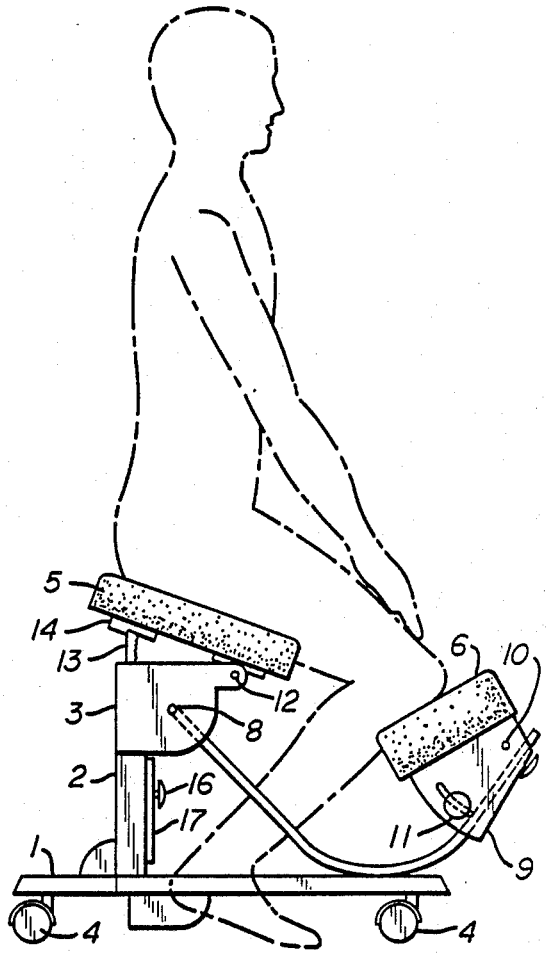
FIG. 2. Chair of FIG. 1 side elevation chair in knee rest position No. 2.

Referring now to FIGS. 1 through 5, there is seen first the supporting structure 1 of a chair of this embodiment. Forming a part of structure 1 is support column 2 upon which is securely positioned a main gusset plate 3. Casters 4 support the entire chair and are of a conventional type. A first cushion 5 which is normally the seat cushion is pivotally mounted on gusset 3 and a second cushion 6, which is normally the back rest cushion, is mounted on an elongated swing arm 7 which may have a curved configuration disposed to rotate about pivot 8 located on gusset 3. The second cushion 6 is pivotally mounted on its own gusset 9 through pivot 10 with adjusting knob 11, all in turn positioned on swinging arm 7.

Figure 5:
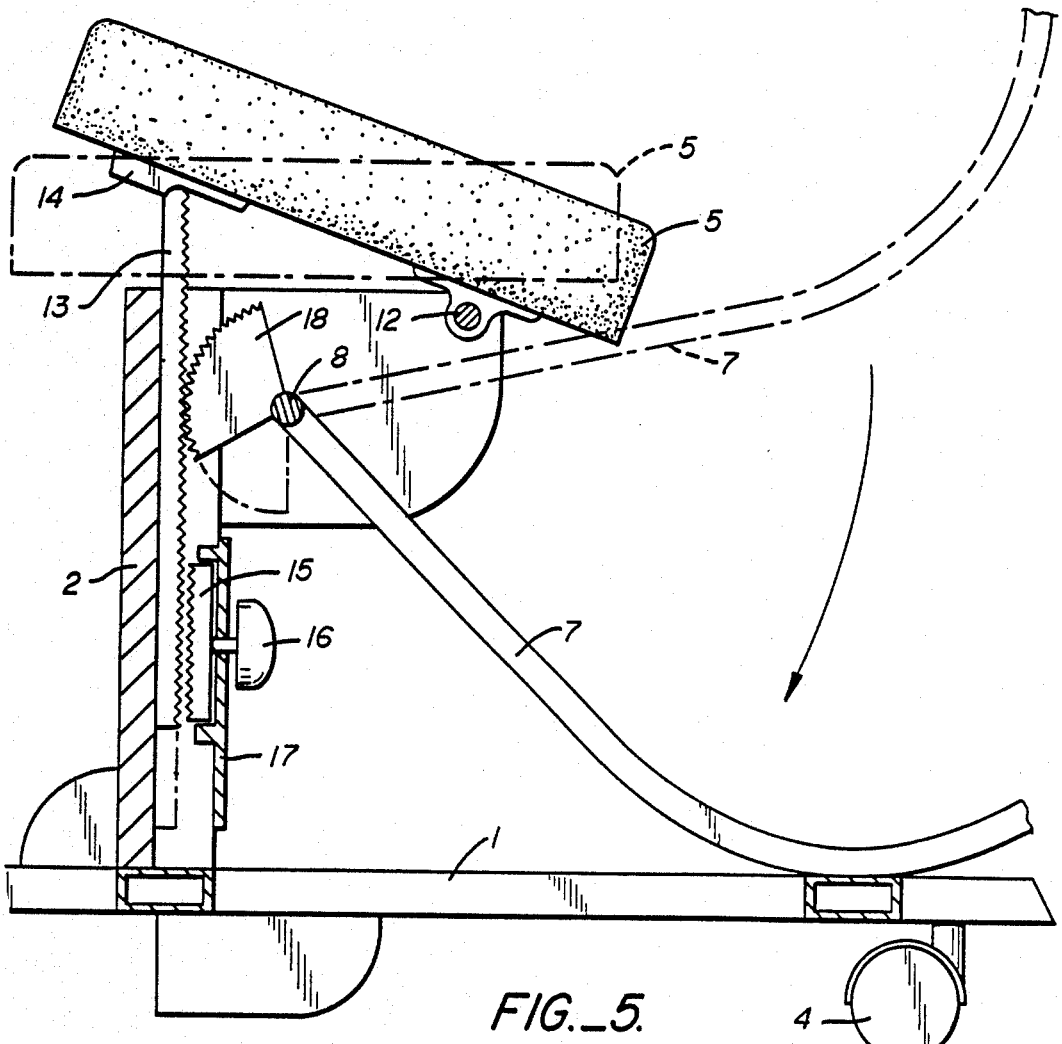
FIG. 5 Chair of FIG. 1 side elevation partially cutaway showing operating mechanism.

The aforementioned pivoting of first cushion 5 is accomplished through pivot 12, also mounted on gusset 3 and adjusting rack 13 positioned inside of hollow column 2. Junction with cushion 5 is made through pad 14. Better seen on FIG. 5 is a second or locking rack 15 disposed to engage the teeth of adjusting rack 13 by means of knob 16 riding on locking plate 17 with its extention members as shown. A pinion 18 which may be segmental in construction is fixedly positioned on one end of arm 7 and will rotate as arm 7 is turned around on pivot 8. This will in turn raise rack 13 causing cushion 5 to tilt to complete putting the chair in a knee rest position as shown on FIG. 2 and FIG. 4.

Figure 3:
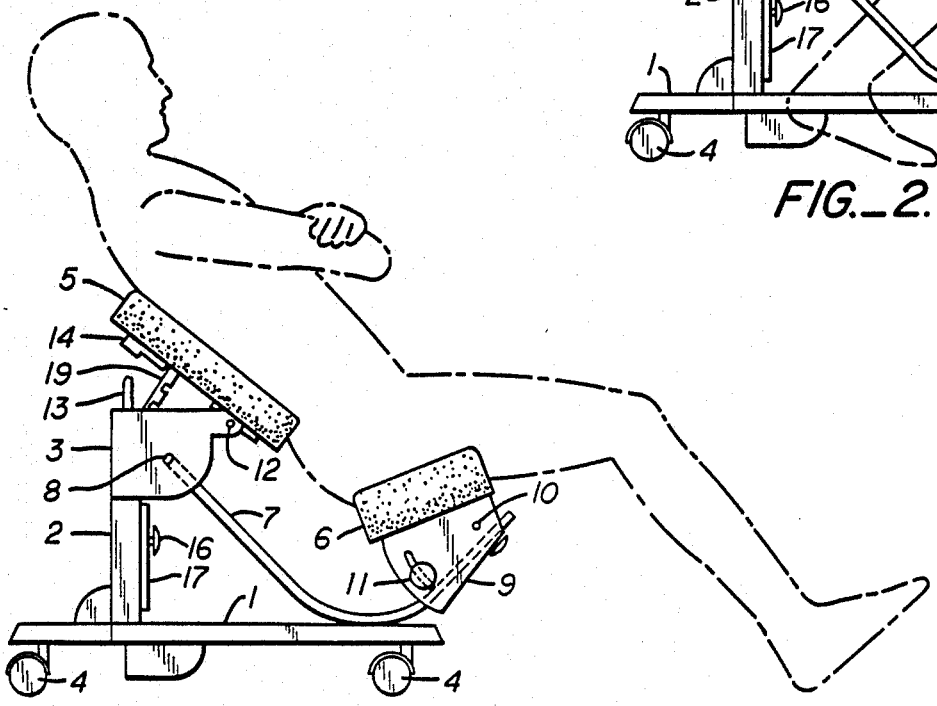
FIG. 3. Chair of FIG. 1 side elevation chair in lounge position No. 3.
Figure 4:
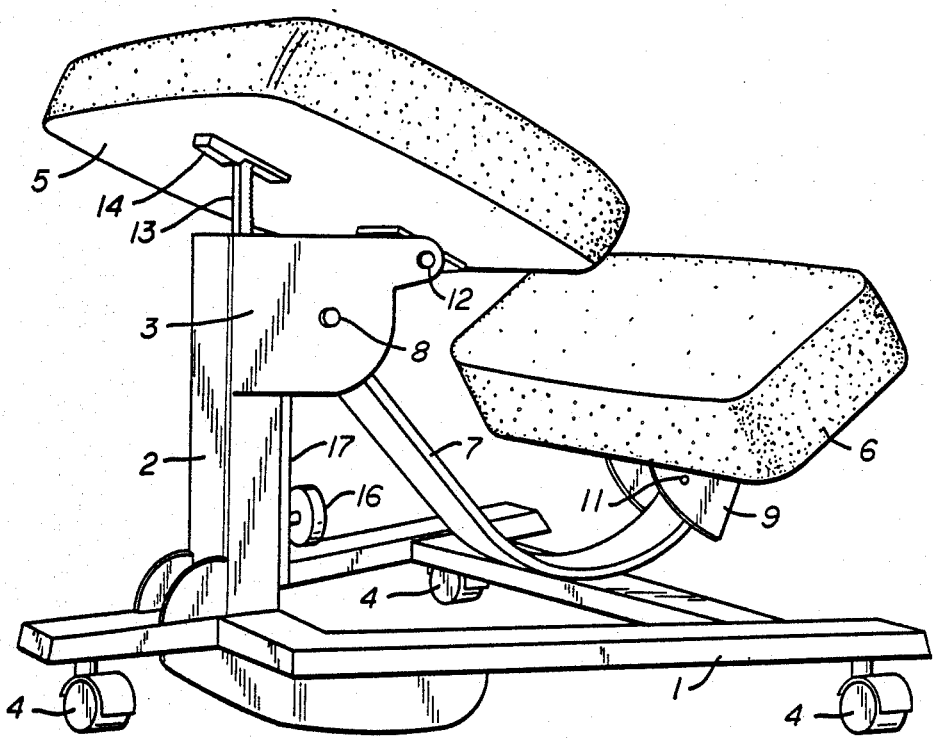
FIG. 4. Chair of FIG. 1 perspective view—chair in knee rest position.

This chair may be utilized also in a lounge position by increasing the tilt of seat cushion 5 by means of adjustment 19 shown on FIG. 3 in which an outline of the user then utilizing cushion 6 as a seat cushion and cushion 5 as a back cushion. An additional back rest cushion may be provided to act as a head rest as described below.

AN ALTERNATE EMBODIMENT

Reference should now be had to FIGS. 6 through 10. Shown here are support structure 21 with a central support column 22 and casters 24 which in general are conventional components of a chair. A first cushion is shown at 25 which is normally the seat cushion and a second cushion 26 which is normally a back rest cushion. Second cushion 26 is positioned on elongated swing or rotating arm 27, the opposite end of which is disposed to swing on pivot 28 through swinging link 29. First cushion 25 is supported on a flat support plate 30 which is pivotally mounted on pivot block 23 by means of pivot 31 which actually may comprise a shaft projecting through pivot block 23.

A solid block having a slotted recess 32 is fixedly positioned on the bottom of plate 30 and disposed to engage a cylindrical catch member 33 positioned on the end of arm 27. A hook engaging latch 34 with operating handle 35 is slidably mounted on arm 27 and disposed to engage shaft 31. Second cushion 26 is pivotally mounted on the end of arm 27 by means of support 36 and angular adjusting device 37.

Figure 6:
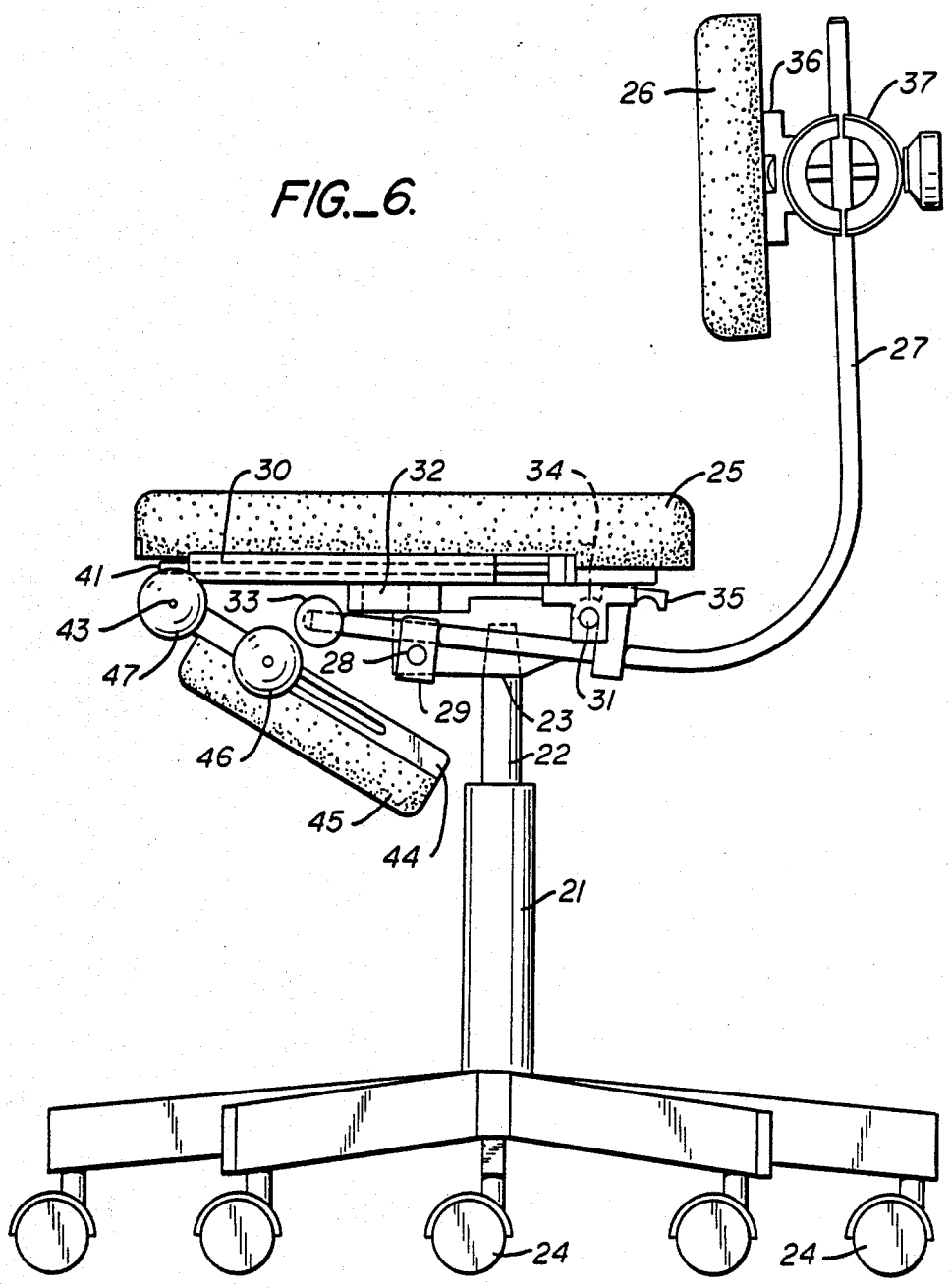
FIG. 6 Chair No. 2 side elevation chair in conventional position No. 1. Optional back rest retracted.
Figure 9:
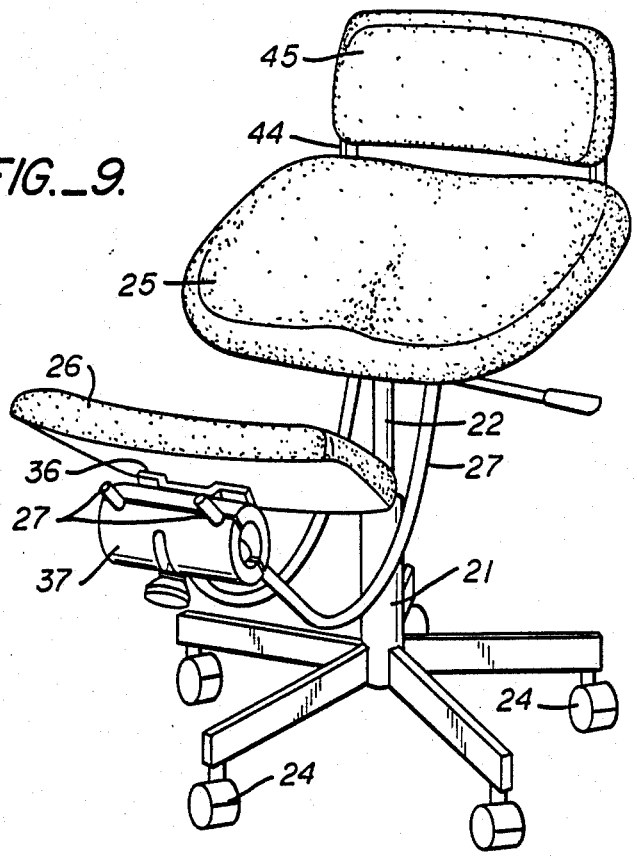
FIG. 9. Chair of FIG. 6. Perspective view. Chair in knee rest position No. 2 with optional back rest in position No. 3.
Figure 7:
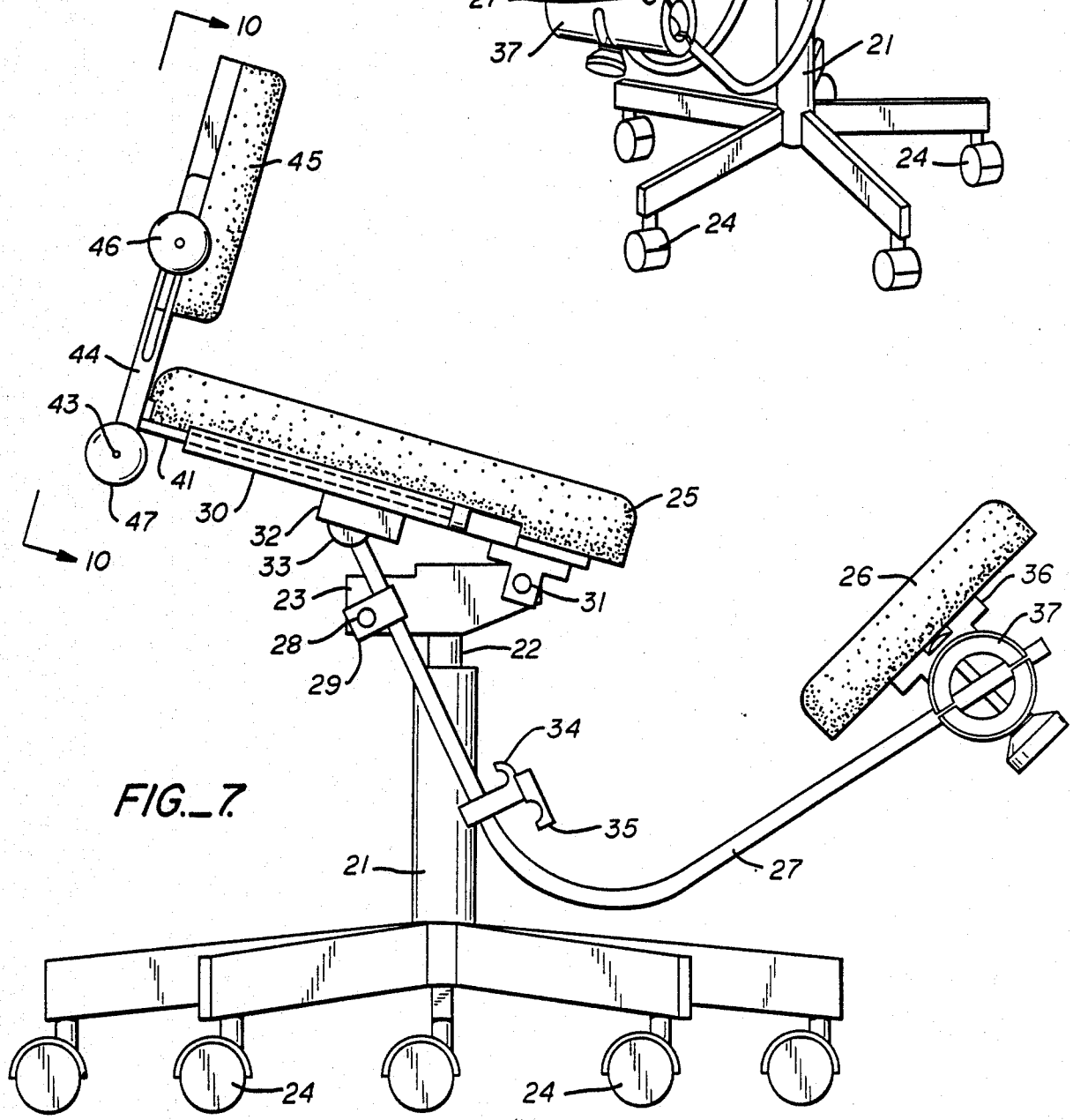
FIG. 7 Chair of FIG. 6 side elevation chair in knee rest position No. 2. Optional back rest in rest position No. 3.
Figure 8:
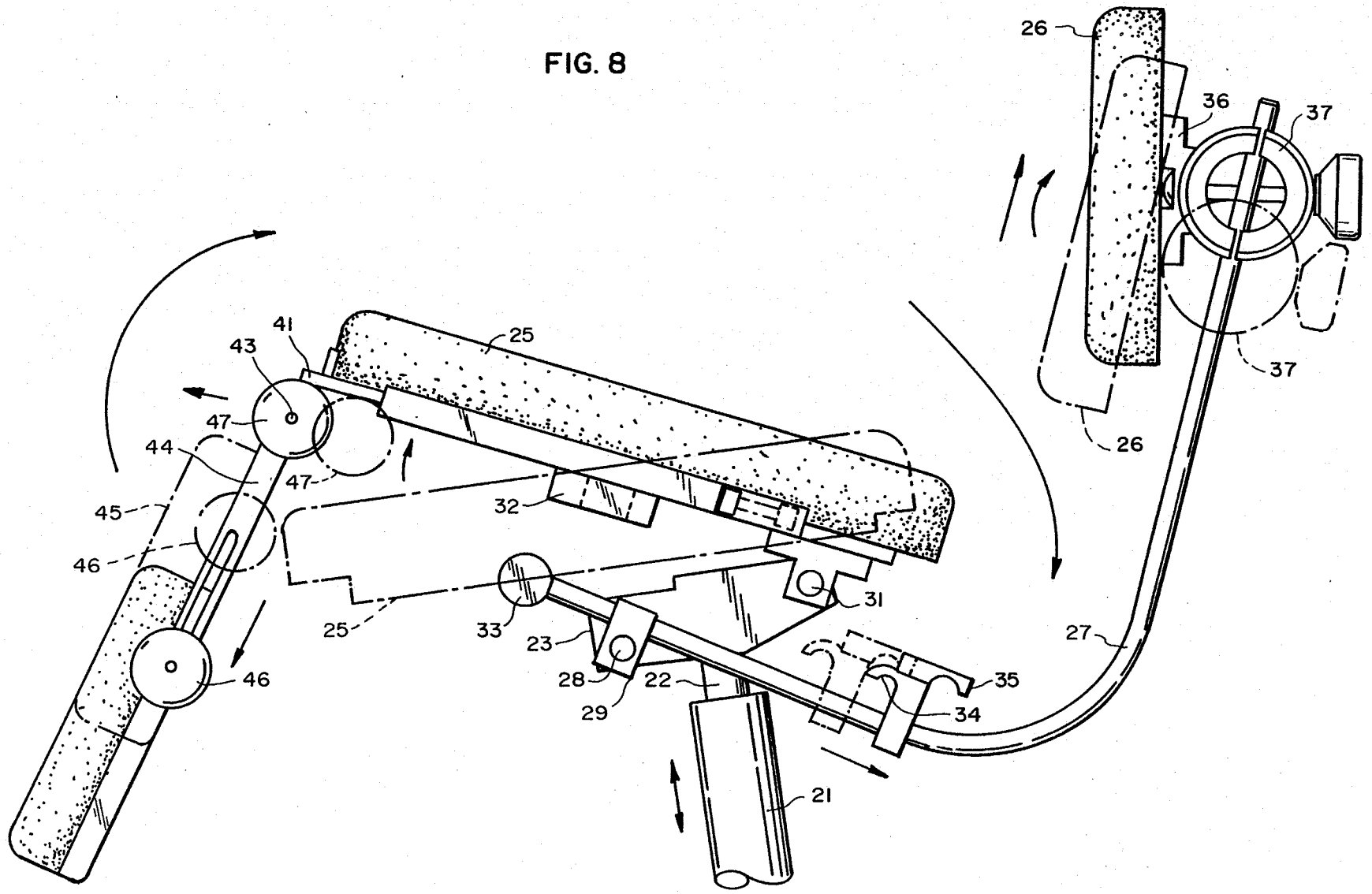
FIG. 8 Chair of FIG. 6. Side elevation and diagram showing steps in converting chair from one position to another.

In order for the chair to be converted from conventional seating position No. 1 of FIG. 6 to knee rest position of FIG. 7 it is merely necessary to slightly raise cushion 25 to disengage latch 34 from shaft 31 and drop arm 27 down until catch member 33 engages block 32. Cushion 25 will now be tilted forward and cushion 26 will be in a position facing it, final adjustment in 26 being made by means of adjustment 37. The chair is now in a knee rest position, position No. 2 of FIG. 7. To restore the chair to conventional position it is merely necessary to repeat these steps. The procedure is more clearly illustrated in the diagram of FIG. 8 which shows the cushions in their respective positions during the transition stage.

FURTHER EMBODIMENT—ADDITIONAL BACK REST OR HEAD REST

Figure 10:
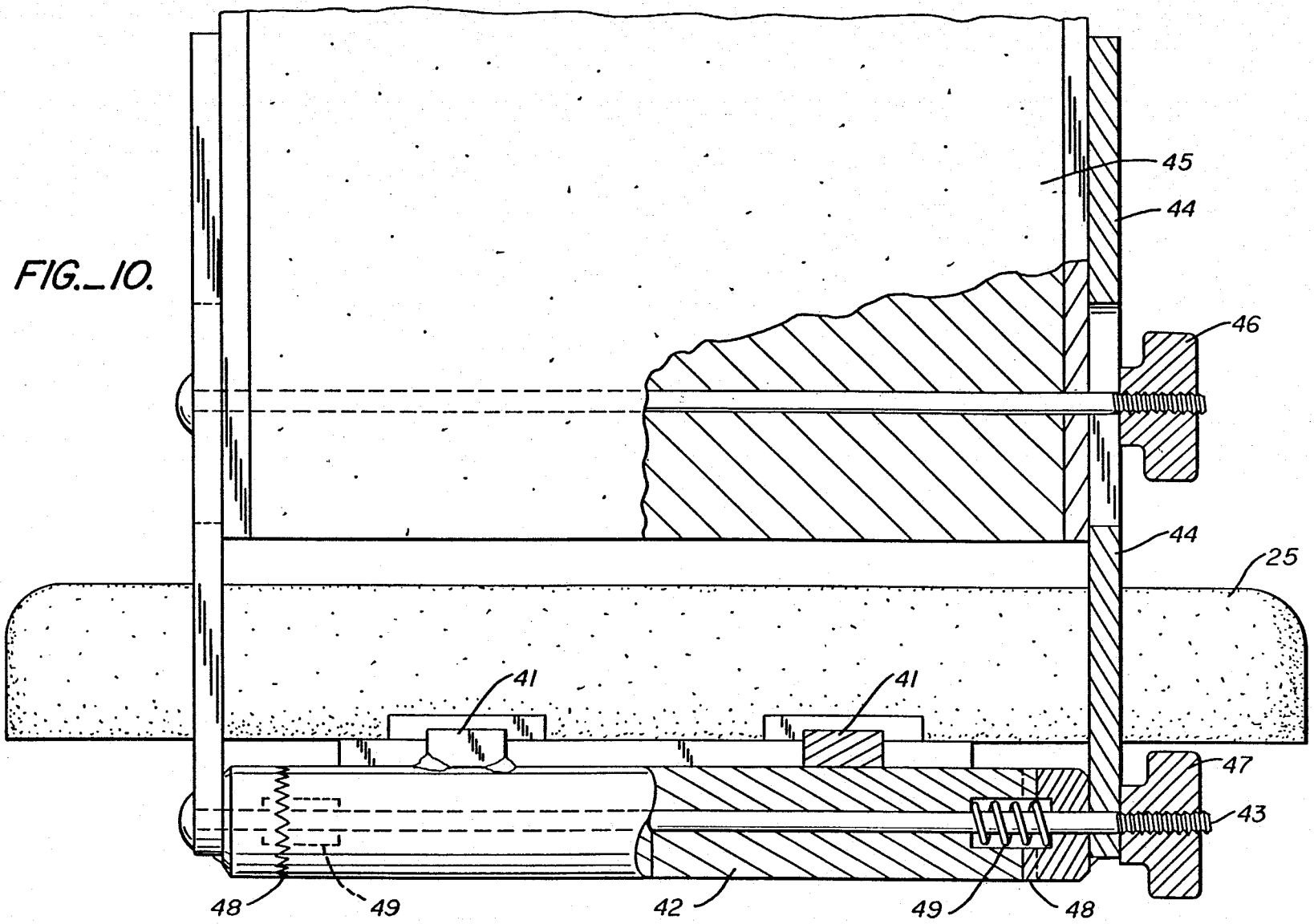
FIG. 10. Chair of FIG. 6. Partial end view cut-away showing mechanism for mounting of optional back rest for position No. 3.

In some cases it is desirable to provide an additional back rest for the chair when it is in the knee rest position, the original back rest of course being now converted to a knee rest. Such a configuration is shown in our perspective of FIG. 9. Referring back to FIG. 6 and FIG. 7 again, we show a slide member 41 inserted into the first cushion support plate 30 under first cushion 25. Reference should also be had to FIG. 10 which is an end view partly in section showing the detail of the support for the additional back rest. Slide members 41 are positioned on bearing 42 which carries shaft 43. Additional swinging arms 44 are fixedly repositioned on jaws 48 and carry the additional back rest cushion 45. The position of cushion 45 along arms 44 may be adjusted by means of knob 46. Cushion 45 may thus be swung upwards as shown in FIG. 7, its vertical position being adjusted by means of the action of knob 47 acting on threaded end of shaft 43 which operates in turn to engage or disengage jaws 48 against the action of spring 49.The additional back rest may act as a head rest for this embodiment when in lounge position of chair No. 1 of FIG. 3.

We claim:

1. A convertible chair having a supporting structure comprising:

a first cushion pivotally mounted on said structure in an initially horizontal position;

said first cushion being mounted on a first pivot means on said structure and disposed to support the posterior of a person;

a second cushion positioned on a rotating arm mounted on a second pivot means in a first initially vertical position on said structure;

said second cushion being disposed to initially support the back of a person while in a seated position on said first cushion;

means for rotating said arm and said second cushion downwards in a vertical plane through a predetermined arc about said second pivot;

interlocking means engaging said first cushion with said rotating arm;

said interlocking means being disposed to position said arm and said second cushion to a second position in spaced relation below and facing said first cushion at a predetermined angle thereto while simultaneously tilting said first cushion forward towards said second cushion about said first pivot means;

thereby causing said second cushion to act as a support for the knee of a person while seated on said first cushion;

said interlocking means being further disposed to hold said second cushion alternately in said first position and in said second position.

2. A convertible chair having a first cushion disposed to support the posterior of a person and a second cushion disposed to support the back of a person while in a normal seated position comprising:

a hollow central support column;

a gusset plate fixedly positioned at the top of one side of said column;

a first pivot pin positioned at the outer edge of said gusset plate;

a second pivot pin positioned on said gusset plate between said first pin and said column;

a rack disposed for longitudinal movement vertically within said column;

a rotating arm disposed for rotation about said second pivot pin through a predetermined vertical arc;

a pinion positioned on the first end of said arm opposite said second pivot;

said pinion being disposed to engage said rack while said arm rotates through said predetermined arc thereby imparting a vertical motion to said rack;

means for holding said rack in a fixed predetermined vertical position;

said first cushion having a first end pivotally mounted on said first pivot pin and an opposite end engaging the top of said rack;

said second cushion pivotally mounted on the second end of said arm opposite said second pivot;

means for rotating said arm and said second cushion from said initial seated position through said predetermined vertical arc to a position below and facing said first cushion while simultaneously raising said rack and tilting said first cushion about said first pivot pin thereby permitting said person to assume a knee rest position on said chair.

3. A convertible chair having a first cushion disposed to support the posterior of a person and a second cushion disposed to support the back of a person while in a normal seated position comprising:

a central support column;

a pivot block having a first and a second end positioned at the top of said column and forming a "T" shaped configuration therewith;

a support plate fixedly positioned on the under surface of said first cushion;

a first pivot pin positioned at the first end of said pivot block;

a second pivot pin positioned at the second end of said pivot block and disposed to engage a first end of said support plate;

a swinging link pivotally engaging said first pivot pin;

a rotating arm slidably engaging said swinging link and disposed to rotate about said first pivot pin through a predetermined vertical arc;

a latch member slidably positioned on said arm and disposed to engage said second pivot pin;

a recessed block fixedly positioned on said plate in spaced relation to said second pin;

a cylindrical catch member positioned on a first end of said arm and disposed to engage said recessed block;

said second cushion being positioned on the second end of said arm;

means for releasing said latch member while said chair is in said normal seated position and rotating said arm and said second cushion through said predetermined vertical arc to a position below and facing said first cushion while simultaneously raising said plate and tilting said first cushion about said second pivot pin until said cylindrical catch member engages said recessed block thereby permitting said person to assume a knee rest position on said chair.

4. The chair of claim 1 or claim 2 or claim 3 including means for adjusting the angle of said second cushion to said rotating arm independently of the position of said arm.

5. The chair of claim 1 or claim 2 or claim 3 including independent means for increasing the angle of tilt of said first cushion to the horizontal over that produced by said rotation of said arm thereby causing said first cushion to constitute a back rest for a person while seated on said second cushion after said arm and said second cushion have been rotated through said predetermined vertical arc thereby permitting said person to assume a lounging position on said chair.

6. The chair of claim 2 or claim 3 including a retractable back rest comprising;

slide member positioned on the under side of said first cushion;

a bearing member fixedly positioned on the outer end of said slide member;

a shaft rotatably positioned in said bearing member;

arms positioned on said shaft and disposed to rotate in a vertical plane;

a third cushion slidably positioned on said arms;

means for holding said slide member in a predetermined horizontal position;

means for fastening said arms in a predetermined angular position;

means for moving said cushion to predetermined fixed positions along said arms;

whereby said third cushion constitutes a retractable back rest for said chair while said person is in a knee rest position and a head rest for said person in a lounge position.

7. A convertible chair having a supporting structure comprising:

a first cushion pivotally mounted on said structure in a first horizontal position;

said first cushion being disposed to support the posterior of a person in a normally seated position while in said first position;

a second cushion positioned on a rotating arm in a first vertical position pivotally mounted on said structure;

said second cushion being disposed to support the back of a person in a normally seated position while in said first position;

means positioned on said structure for engaging said cushions in said first positions;

means for rotating said arm and said second cushion downwards and away from said first cushion in a vertical plane through a predetermined arc to a second position and for simultaneously tilting said first cushion to a second position towards said second cushion;

said second position of said second cushion being below and facing said first cushion and in spaced relation thereto;

means for interlocking said cushions alternately in said first and in said second positions;

thereby causing said second cushion to act as a support for the knees of a person seated on said first cushion.

8. A convertible chair having a first cushion disposed to support the posterior of a person and a second cushion disposed to support the back of a person while in a normal seated position comprising:

a central support column;

a pivot block positioned at the top of said column and forming a "T" shaped configuration therewith;

a support plate fixedly positioned on the under surface of said first cushion;

first pivot means positioned at the first end of said pivot block;

second pivot means positioned at the second end of said pivot block and disposed to engage a first end of said support plate;

a rotating arm disposed for rotation about said first pivot means;

said second cushion being positioned on said arm;

means positioned on said support plate for maintaining said first cushion and said second cushion in position for holding said person in said normal seated position;

means for rotating said arm and said second cushion through a predetermined vertical arc in a direction downwards and away from said support plate and simultaneously tilting said support plate towards said second cushion to a knee-rest position;

means positioned on said support plate for maintaining said first cushion and said second cushion in said knee-rest position.

9. A convertible chair having a supporting structure comprising:

a first cushion pivotally mounted on said structure in an initially horizontal position;

said first cushion being mounted on a first pivot means on said structure and disposed to support the posterior of a person;

a second cushion positioned on a rotating arm mounted on a second pivot means in a first initially vertical position on said structure;

said second cushion being disposed to initially support the back of a person while in a seated position on said first cushion;

said second pivot means comprising a fixed fulchrum mounted on said structure;

means for rotating said arm and said second cushion downwards in a vertical plane through a predetermined arc about said fixed fulchrum to a second position;

interlocking means engaging said first cushion with said rotating arm and said second cushion;

said interlocking means being disposed to position said arm and said second cushion to a second position in spaced relation below and facing said first cushion at a predetermined angle thereto while simultaneously tilting said first cushion forward towards said second cushion about said first pivot means;

thereby causing said second cushion to act as a support for the knees of a person while seated on said first cushion;

said fulchrum and said interlocking means further disposed to hold said arm and said second cushion alternately in said first position and in said second position.

* * * * *